US007077635B2

(12) United States Patent
Garczorz et al.

(10) Patent No.: US 7,077,635 B2
(45) Date of Patent: Jul. 18, 2006

(54) PUMP COMPRISING A WATER SUPPLY

(75) Inventors: Reinhard Garczorz, Loerrach (DE); Fritz-Martin Scholz, Hasel (DE)

(73) Assignee: Werner Rietschle GmbH + Co. KG (DE)

( * ) Notice: Subject to any disclaimer, the term of this patent is extended or adjusted under 35 U.S.C. 154(b) by 0 days.

(21) Appl. No.: 10/363,130

(22) PCT Filed: Sep. 12, 2001

(86) PCT No.: PCT/EP01/10536

§ 371 (c)(1),
(2), (4) Date: Mar. 6, 2003

(87) PCT Pub. No.: WO02/23046

PCT Pub. Date: Mar. 21, 2002

(65) Prior Publication Data

US 2004/0037727 A1 Feb. 26, 2004

(30) Foreign Application Priority Data

Sep. 12, 2000 (DE) ..... 200 15 744

(51) Int. Cl.
*F03C 2/00* (2006.01)
*F04C 2/00* (2006.01)

(52) U.S. Cl. ..... 418/206.3; 418/84; 418/85; 418/206.1; 184/6.23

(58) Field of Classification Search ..... 418/84, 418/85, 206.1, 206.3; 184/6.23
See application file for complete search history.

(56) References Cited

U.S. PATENT DOCUMENTS

| | | | | |
|---|---|---|---|---|
| 2,906,448 | A * | 9/1959 | Albert | 418/85 |
| 3,430,848 | A | 3/1969 | Turner et al. | |
| 3,759,348 | A * | 9/1973 | Kasahara | 418/84 |
| 3,795,117 | A | 3/1974 | Moody, Jr. et al. | |
| 4,173,440 | A * | 11/1979 | Libis | 418/84 |
| 4,861,246 | A | 8/1989 | Zimmern | |
| 5,511,953 | A | 4/1996 | Holzheimer et al. | |
| 6,102,683 | A | 8/2000 | Kirsten | |
| 6,719,546 | B1 * | 4/2004 | Foerster | 418/84 |

FOREIGN PATENT DOCUMENTS

| | | |
|---|---|---|
| DE | 1 628 348 | 3/1969 |
| DE | 198 06 346 A1 | 11/1999 |
| DE | 199 49 730 A | 5/2000 |
| EP | 0 172 430 | 2/1986 |
| EP | 638 723 A1 | 2/1995 |
| JP | 63068793 A * | 3/1988 |

OTHER PUBLICATIONS

International Search Report (Dated Dec. 11, 2001).
German Search Report (Dated Jun. 12, 2001).

* cited by examiner

*Primary Examiner*—Theresa Trieu
(74) *Attorney, Agent, or Firm*—James B. Conte; Barnes & Thornburg LLP

(57) ABSTRACT

A pump (12) for generating pressure and/or negative pressure comprises a pump chamber having a high-pressure port (16) and a low-pressure port (14), and two at least two-blade rotors which are mounted in the pump chamber on two parallel shafts offset in relation to each other. The rotors roll off onto each other free of contact during rotation while forming cells with an internal compression. Provision is made for a supply of a cooling agent (21) into the pump chamber, the supply being closed-loop controlled depending on the temperature on the side of the high-pressure port (16).

7 Claims, 2 Drawing Sheets closed loop 21
coolant
$P_N$
M
24
22
20
18
$T_2, P_2$
$P_0, T_0$
14
12
16

12

30
$P_N$
36
40
32
122
21
closed-loop control
cooling agent
$T_2$
42
42
18
42
16
38
34

PUMP COMPRISING A WATER SUPPLY

BACKGROUND OF THE INVENTION

The invention relates to a pump for generating pressure and/or negative pressure, comprising a pump chamber having a high-pressure port and a low-pressure port, and two at least two-blade rotors which are mounted in the pump chamber on two parallel shafts offset in relation to each other, the rotors rolling off onto each other free of contact during rotation while forming cells with an internal compression. Pumps of this design are also referred to as claw-type compressors.

In the known claw-type compressors, the heat developing during compression is dissipated by means of a cooling air flow at the outer surface of the housing provided with cooling fins or by a cooling water circulation integrated in the housing.

BRIEF SUMMARY OF THE INVENTION

The invention provides a further development of a pump of the type mentioned above to the effect that at least a substantial portion of the heat of compression is eliminated via a cooling agent introduced into the compressor space. In accordance with the invention, provision is made for a supply of a cooling agent into the pump chamber, the supply being closed-loop controlled depending on the temperature on the side of the high-pressure port. The temperature-dependent closed-loop control of the volume flow of the cooling agent supplied reliably prevents the pump from overheating under heavy-duty operating conditions. For this reason, the pump according to the invention is suitable in particular for use in combination with fuel cells in motor vehicles. Further essential advantages are as follows:

- compact design owing to a reduced requirement of external cooling;
- small temperature differences in operation because the heat of compression is dissipated directly at the place where it develops;
- smaller gaps between the rotors and the housing and, hence, improved efficiency;
- humidification of the compressed air, as is of advantage in certain processes.

Water is especially suited to serve as cooling agent.

In the preferred embodiment of the invention, at least one injection nozzle for the cooling agent is arranged to open into the pump chamber, preferably a two-component atomizer nozzle which, in addition to the liquid cooling agent, is supplied with a gaseous volume flow which is branched off from the high-pressure port. The two-component atomizer nozzle is provided with a flow regulating member which is engaged by an actuating drive.

BRIEF DESCRIPTION OF THE DRAWINGS

Details of the invention will be apparent from the accompanying drawings in which.

DETAILED DESCRIPTION OF THE INVENTION

Figure 1:
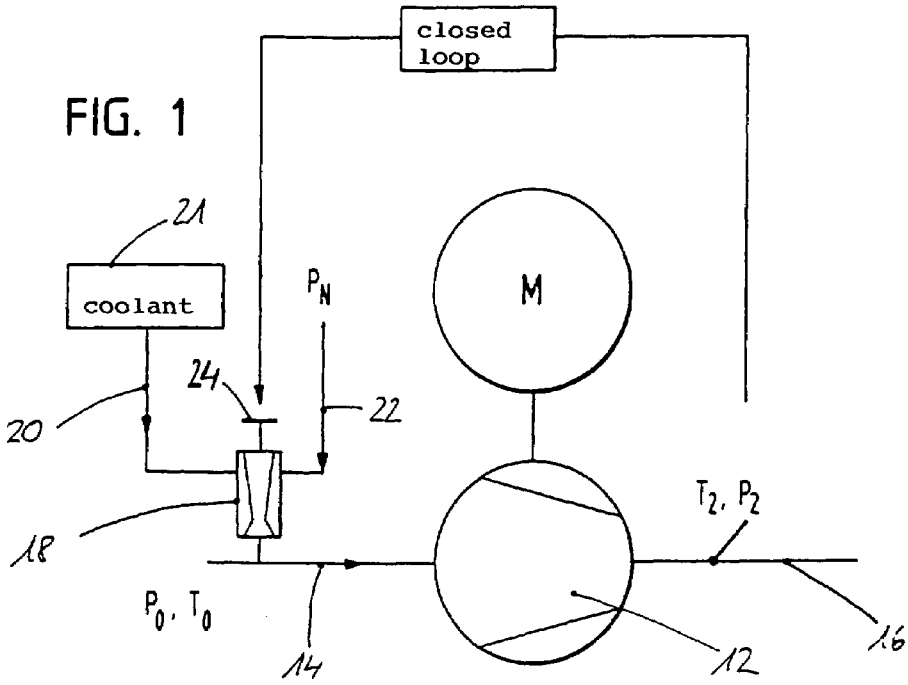
FIG. 1 shows a schematic diagram of the pump in accordance with the invention, having a temperature-controlled water supply fed directly into the compressor space and using an adjustable two-component atomizer nozzle.

The schematic diagram illustrated in FIG. 1 shows a pump 12 which is operated by an electric motor M and is connected with a suction pipe 14 on the input side and with a pressure pipe 16 on the output side. A gaseous medium having a pressure $P_0$ and a temperature $T_0$ may be supplied to the pump 12 via the suction pipe 14 and a gaseous medium having a pressure $P_2$ and a temperature $T_2$ may be discharged from the pump via the pressure pipe 16. Opening into the suction pipe 14 there is a two-component atomizer nozzle 18 which may be supplied with cooling water 21 via a cooling agent supply 20 and with compressed air via a compressed air supply 22. The two-component atomizer nozzle 18 is provided with a flow regulating member which may be actuated via an engaging actuator drive 24. The quantity of cooling water to be fed in is determined via a closed loop. For the closed-loop control a temperature sensor is provided in the pressure pipe 16 which measures the temperature $T_2$ of the gaseous medium exiting the pump 12. The temperature $T_2$ as measured is compared with a set point $T_s$ and the temperature difference $T_2-T_s$ is deviation-controlled by the flow of the liquid cooling agent by means of driving the actuator drive 24.

Figure 2:
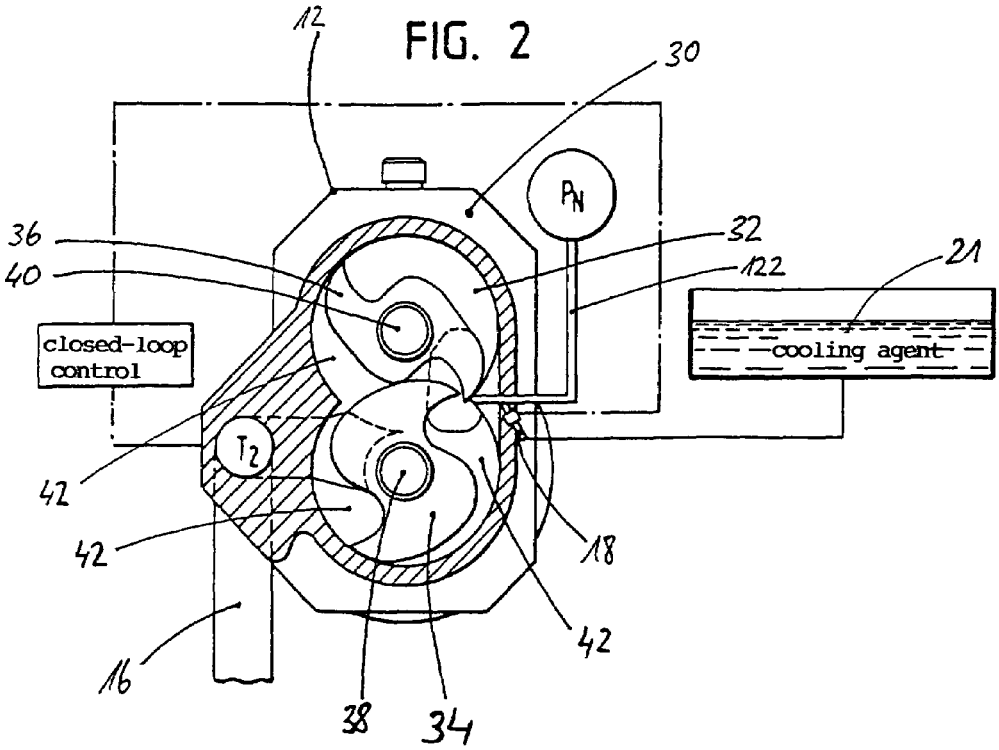
FIG. 2 shows a diagrammatic sectional view of a claw-type compressor having a temperature-controlled water supply according to the schematic diagram of FIG. 1.

FIG. 2 shows the pump in accordance with the invention as illustrated in FIG. 1 in a diagrammatic sectional view. The pump 12 includes a housing 30 having a pump chamber 32 formed therein. Inside the pump chamber 32, two two-blade rotors 34, 36 are each supported on a shaft 38, 40. The shafts 38, 40 are arranged to be parallel and offset in relation to each other. The rotors 34, 36 roll off onto each other free of contact during rotation while forming cells 42 of variable size, with an internal compression taking place. The heat arising in operation of this so-called claw-type compressor 12 is substantially dissipated by the temperature-controlled water supply as described in FIG. 1. The amount of water required for cooling is atomized via the two-component atomizer nozzle 18 directly into the pump chamber 32.

Figure 3:
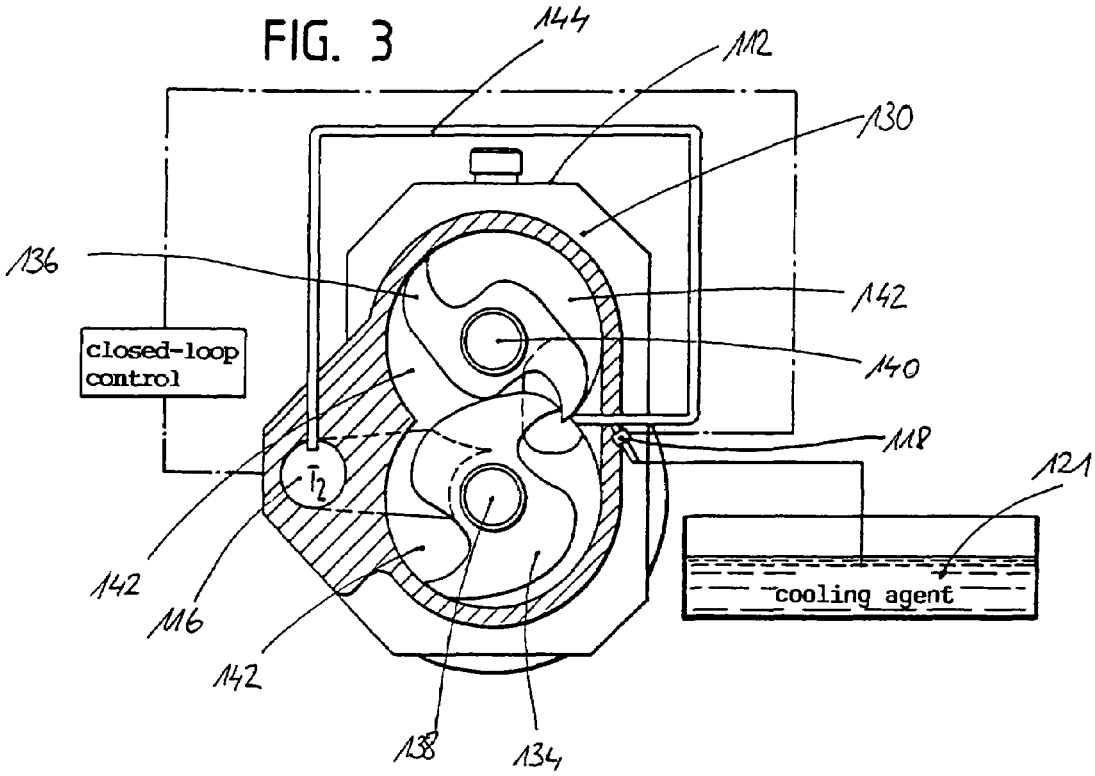
FIG. 3 shows a variant of the claw-type compressor of FIG. 2, in which the system pressure on the outlet side is made use of for atomization of the cooling water supplied.
Figure 4:
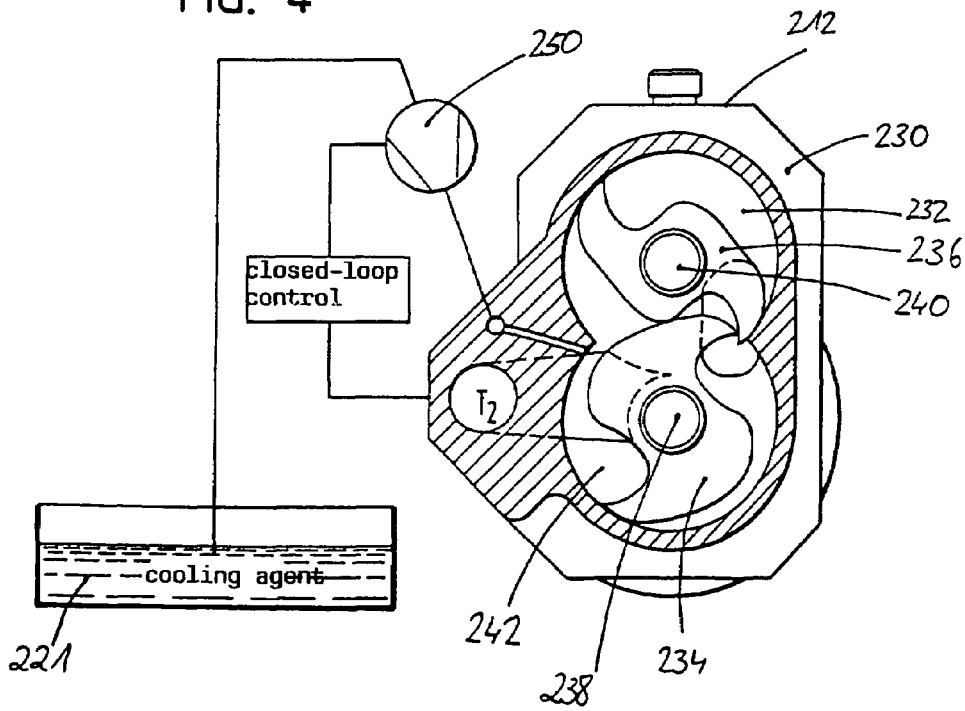
FIG. 4 shows a diagrammatic section of a claw-type compressor having a temperature-controlled water supply fed directly into the compressor space and using a controllable injection pump.

In the pump shown in FIG. 3, for elements which correspond to elements shown in FIGS. 1 and 2, the same reference numerals are used increased by "100." In the pump shown in FIG. 4, for elements which correspond to elements shown in FIGS. 1 and 2, the same reference numerals are used increased by "200."

The claw-type compressor 112 depicted in FIG. 3 corresponds to the claw-type compressor 12 depicted in FIG. 2. In contrast to the closed cooling loop illustrated in FIG. 2, in this case the gaseous volume flow supplied to the two-component atomizer nozzle 118 is branched off from the pressure pipe 116 and is returned to the two-component atomizer nozzle 118 via a conduit 144. The system pressure on the outlet side is made use of in this way for atomization of the cooling water 121 supplied.

In the embodiment illustrated in FIG. 4, the cooling water 221 is supplied into the pump chamber 232 of the claw-type compressor 212 directly via a controllable injection pump 250. The quantity of cooling water to be supplied by the pump is closed-loop controlled using the temperature $T_2$ of the gaseous medium exiting the pump chamber 232 in a way analogous to the schematic diagram of FIG. 1.

In accordance with a further embodiment according to the invention, provision is made that the liquid cooling agent is not fed directly into the pump chamber by the controllable injection pump, but is supplied via an injection nozzle connected between the pump chamber and the injection pump.

Provision is further made in accordance with the invention that the injection nozzle opens into the pump chamber in the area of the pressure pipe or that an injection nozzle in addition to the injection nozzle in the area of the suction pipe opens into the pump chamber in the area of the pressure pipe.

The temperature-controlled supply of the cooling water directly into the pump chamber serves to reliably avoid overheating of the pump even under heavy-duty conditions of use. In comparison with pumps having an external cooling as known from the prior art, the pump in accordance with the invention presents the advantage that it requires less space as a result of its compact design. Since the heat generated on compression is dissipated directly at the place where it develops, namely in the pump chamber, only small temperature differences appear between the housing and the rotors, as compared with a pump having an external cooling, resulting in a minimum temperature expansion of the rotors occurring in operation so that the pump may be designed with very small gaps between the rotor and the housing. As a result of the gap reduction, backflows are minimized and the efficiency is optimized.

The invention claimed is:

1. A pump for generating pressure and/or negative pressure, comprising a pump chamber having a high-pressure port and a low-pressure port, and two at least two-blade rotors which are mounted in said pump chamber on two parallel shafts offset in relation to each other, said rotors rolling off onto each other free of contact during rotation while forming cells with an internal compression, a supply of a liquid cooling agent is provided to the pump chamber, said supply being closed-loop controlled depending on the temperature on the side of the high-pressure port, and at least one two-component atomizer nozzle for said cooling agent arranged to open into said pump chamber wherein, in addition to the liquid cooling agent, a gaseous volume flow which is branched off from the high-pressure port is supplied to the two-component atomizer nozzle.

2. The pump as claimed in claim 1, wherein the cooling agent is water.

3. The pump as claimed in claim 1, wherein said at least one atomizer nozzle opens into the pump chamber in the area of the low-pressure port.

4. The pump as claimed in claim 1, wherein said at least one atomizer nozzle opens into the pump chamber in the area of the high-pressure port.

5. The pump as claimed in claim 1, wherein the two-component atomizer nozzle is provided with a flow regulating member which is engaged by an actuating drive.

6. The pump as claimed in claim 1, wherein said atomizer nozzle is fed by a controllable injection pump.

7. The pump as claimed in claim 1, wherein the two-component atomizer nozzle is provided with a flow regulating member which is engaged by an actuating drive.

* * * * *